United States Patent [19]

Chu

[11] 4,330,269

[45] May 18, 1982

[54] REFRACTORY SAGGER

[76] Inventor: Shieh C. Chu, No. 1, Alley 2, Lane 474, Chung-Ho St., Pei-Tou District, Taipei, Taiwan

[21] Appl. No.: 225,146

[22] Filed: Jan. 14, 1981

[51] Int. Cl.[3] ..... F27D 5/00

[52] U.S. Cl. ..... 432/258; 432/259

[58] Field of Search ..... 432/252, 253, 258, 259, 432/264, 265

[56] References Cited

U.S. PATENT DOCUMENTS

| | | | |
|---|---|---|---|
| 1,860,374 | 5/1932 | Vincent | 432/259 |
| 2,179,635 | 11/1939 | Kimmel | 432/238 |
| 2,552,640 | 5/1951 | Morin | 432/258 |
| 3,948,594 | 4/1976 | Irwin | 432/259 |
| 4,182,609 | 1/1980 | Hovis et al. | 432/234 |

FOREIGN PATENT DOCUMENTS

| | | | |
|---|---|---|---|
| 1081230 | 12/1954 | France | 432/258 |

*Primary Examiner*—John J. Camby

[57] ABSTRACT

A refractory sagger comprises of a bottom wall having a netted frame which is defined by a plurality of alloy wires e.g. nichrom wires, ferrochrome wires, inserted therein, and a surrounding wall having an upwardly faced groove filled with an alloy wire and glaze. The expansion coefficient of the said glaze matches with that of the said refractory sagger.

3 Claims, 4 Drawing Figures

REFRACTORY SAGGER

BACKGROUND OF THE INVENTION

The present invention relates to a refractory sagger for receiving raw ceramics or mosaic tiles to be burned, and more particularly to an improved refractory sagger of which uniform thermal expansion of the whole sagger under heating can be obtained so that cracking is rarely happened in the sagger even at sudden cooling or heating.

Although conventional sagger is primarily made of cordierite (2 Mg 0.2 $Al_2O_3.5SiO_2$) which exhibits a low expansion coefficient, crack will be produced in the sagger at sudden cooling or heating. Once there is a crack in the sagger and the sagger has been used several times, the sagger will be broken into pieces, and becomes a waste. Normally, a sagger can only be used for about 40 times. In addition, since the saggers are closely stacked in the kilns during burning, it is difficult to separate the stacked saggers away from each other without the aid of special tools after they are moved out from the kilns and have been cooled.

SUMMARY OF THE INVENTION

Accordingly, it is the principal object of the present invention to provide a novel and improved sagger of which uniform thermal expansion of the whole sagger under burning can be obtained, which overcomes the disadvantages of conventional sagger.

Another object of the present invention is to provide an improved sagger which includes a surrounding wall having an upwardly faced groove being filled with an alloy wire and glaze which exhibits an expansion coefficient matching with the expansion coefficient of the sagger, and which glaze may be in the molten state under heating and in case if a crack occurs in the glaze in the surrounding groove as produced after being used for a long time, the molten state under heating is able to connect it together so as to avoid complete break of the sagger.

A further object of the present invention is to provide an improved sagger which includes a bottom wall having a netted frame which is defined by a plurality of alloy wire, inserted therein in order to prevent the bottom wall from being distorted.

A still further object of the present invention is to provide an improved sagger which includes a surrounding wall having a plurality of spaced protrusions formed on the outer top surface of the surrounding wall in a line in order to facilitate separation of the stacked saggers.

Other objects of the invention will become apparent from the following description.

DESCRIPTION OF THE PREFERRED EMBODIMENT

Figure 1:
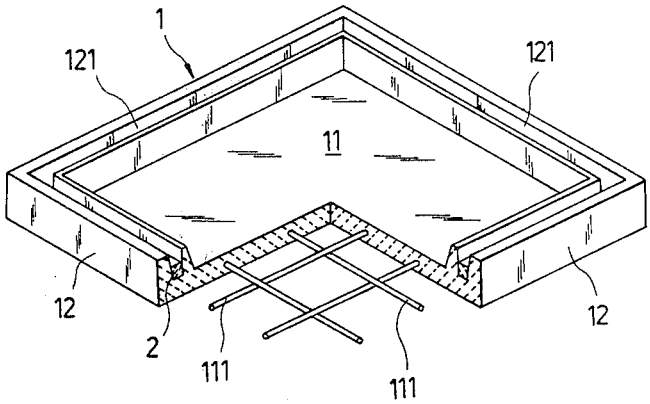
FIG. 1 is a perspective view of an embodiment of the refractory sagger according to the present invention.
Figure 2:
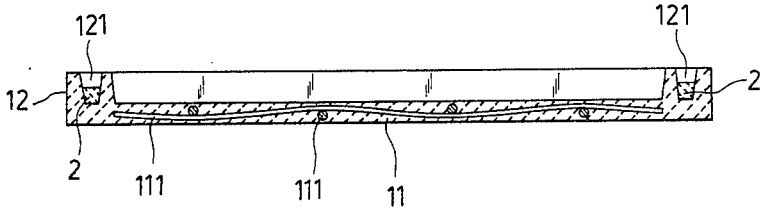
FIG. 2 is a longitudinal sectional view taken along line II—II of FIG. 1.

Referring to FIGS. 1 and 2, the refractory sagger comprises of a bottom wall 11 having a netted frame 111 defined by a plurality of alloy wires e.g. nichrom wires (SUMITOMO BRAND. melting point 1400° C.), ferrochrom wires (SUMITOMO BRAND. melting point 1510° C.), inserted therein, and a surrounding wall 12 having an upwardly faced groove 121 filled with the glaze 2 whose expansion coefficient matches with that of the sagger. The bottom wall 11 and surrounding wall 12 are integrally formed by means of the mold in order to form an inner space for receiving raw ceramics or masaic tiles to be burned. They are made from a mixture of 60 percent used cured broken sagger, 15 percent Pei-To clay, 15 percent Hong Kong ball clay, 5 percent Korea clay by weight. A further 12 percent of water by weight will then be added into said mixture which is regarded as 88 percent by weight.

Half of the said mixture is first fed into the mold, and then a netted frame defined by a plurality of alloy wire e.g. nichrom wires, ferrochrom wires, is arranged on said half of mixture, and the other half is fed into the mold, after these steps, a pressure is applied to the surface of said mixture in order to form a raw sagger.

The glaze is made from a mixture of Potash feldspar ($K_2O.Al_2O_3.6SiO_2$), Lime (CaO), Zine Oxide ($Z_nO$), Quartz ($SiO_2$) and water. They are mixed in proper proportion (e.g. according to Seger formula) by means of the ball mill. The glaze may be in the soldified state at room temperature, and in the molten state under heating at temperature about 1160° C.

The fluid glaze is poured into the groove 121 after the raw sagger has been burned for the cured sagger.

In the present invention, even though there is a crack in the sagger after being used for a long time, the crack appears in the glaze in the surrounding groove would be connected together by melt fusion, and be soldified after cooling. In practice, since said crack is slim, and the molten glaze is in the controlled high density state, the molten glaze will not flow out from the sagger.

Figure 3:
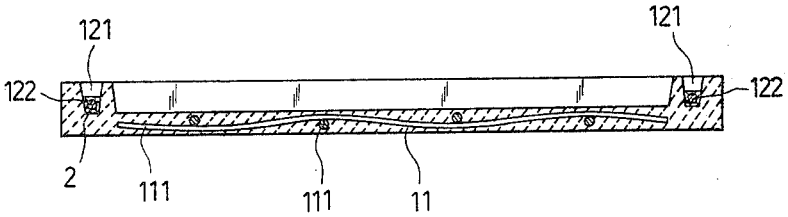
FIG. 3 is a longitudinal sectional view similar to FIG. 2 shows another embodiment of the refractory sagger according to the present invention.

Referring now to FIG. 3. FIG. 3 shows another embodiment of the refractory sagger according to the present invention. In this embodiment, the refractory sagger of FIG. 1 is further provided with an alloy wire 122, e.g. nichrome wire, ferrochrome wire. The alloy wire 122 is inserted in the glaze 121 in a direction of longitudinal length in order to enhance the tensile strength of the glaze.

Figure 4:
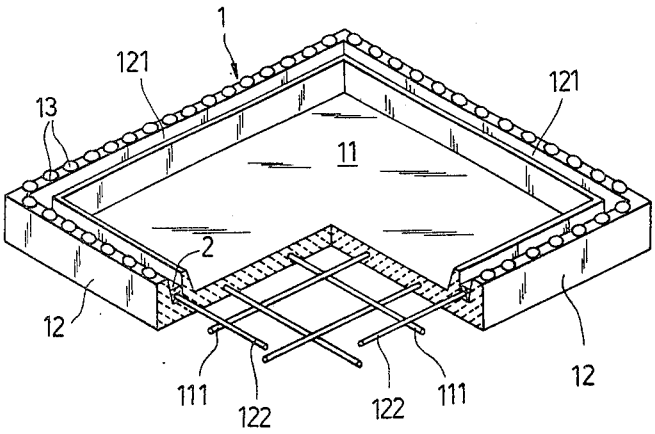
FIG. 4 is a perspective view similar to FIG. 1 and shows another embodiment of the refractory sagger according to the present invention.

FIG. 4 shows another embodiment of the refractory sagger according to the present invention. In this embodiment, a plurality of spaced protrusions 13 are integrally formed on the outer top surface of the surrounding wall of FIG. 1 in a line in order to form point contact between two adjacent stacked saggers so that separation of the adjacent stacked saggers may be easily carried out and the efficiency of heat cycle may be enhanced.

What is claimed is:

1. A refractory sagger comprising: a bottom wall having a netted frame which is defined by a plurality of alloy wires selected from the group consisting of nichrome wire, and ferrochrome wire, inserted therein, and a surrounding wall having an upwardly facing groove in the form of a closed loop surrounding said bottom wall, said groove being filled with glaze formed therein, said glaze having an expansion coefficient matching with the expansion coefficient of said refractory sagger.

2. The refractory sagger according to claim 1, wherein an alloy wire e.g. nichrome wire, ferrochrome wire, is inserted into the glaze in the groove of the surrounding wall in a direction of longitudinal length.

3. The refractory sagger according to claim 1, wherein a plurality of spaced protrusions are integrally formed on the outer top surface of the surrounding wall.

* * * * *